United States Patent [19]

Nilsson et al.

[11] Patent Number: 4,612,865

[45] Date of Patent: Sep. 23, 1986

[54] APPARATUS FOR THE COMBUSTION OF SOLID FUELS

[75] Inventors: Jan-Åke I. Nilsson, Bjärred; Bengt L. Hansson, Löddeköpinge, both of Sweden

[73] Assignee: Rippelton N.V., Curacao, Netherlands Antilles

[21] Appl. No.: 754,425

[22] Filed: Jul. 12, 1985

[30] Foreign Application Priority Data

Jul. 26, 1984 [SE] Sweden ..... 8403865

[51] Int. Cl.[4] ..... F23G 5/06

[52] U.S. Cl. ..... 110/244; 110/247; 110/265; 110/186

[58] Field of Search ..... 110/346, 244, 243, 259, 110/266, 170; 122/387; 15/104.05

[56] References Cited

U.S. PATENT DOCUMENTS

| | | | |
|---|---|---|---|
| 745,642 | 12/1903 | Miller | 122/387 |
| 2,979,000 | 4/1961 | Sifrin et al. | 110/266 |
| 3,199,476 | 8/1965 | Nettel | 110/265 |
| 3,678,870 | 7/1972 | Bakkar | 110/186 |
| 3,680,503 | 8/1972 | Danielsson et al. | 110/247 |
| 3,777,678 | 12/1973 | Tutes et al. | 110/244 |
| 3,797,413 | 3/1974 | Ali et al. | 110/244 |
| 3,831,535 | 8/1974 | Baardson | 110/186 |

*Primary Examiner*—Henry C. Yuen

*Attorney, Agent, or Firm*—Murray and Whisenhunt

[57] ABSTRACT

A cyclone furnace for the combustion of solid fuels, comprising a generally cylindrical combustion chamber (21) is closed at one end (18, 23) and is provided with at least one inlet opening for fuel and air and has an outlet at the end opposite the closed end. The combustion chamber (21) is generally horizontal. The combustion chamber, at the bottom of the cylindrical wall (22), near the end wall (23), is provided with an opening (87) for discharging ash. An ash discharge conduit (12) is arranged intermediate said ash discharge opening and an ash bin (16) or the like. An ash discharge sluice (92) is provided in the discharge conduit, and scraping means (45, 47) are provided to scrape loose ash and slag from the surface of the end wall (23) and from the combustion chamber wall (22) next to the end wall, said scraping means being arranged to be rotated about the horizontal axis of the combustion chamber (21).

11 Claims, 10 Drawing Figures

APPARATUS FOR THE COMBUSTION OF SOLID FUELS

TECHNICAL FIELD

The invention relates to a cyclone furnace for solid fuels, comprising a generally cylindrical combustion chamber which is closed at one end and provided with an opening for supplying combustion air and fuel, said opening being directed essentially tangentially. The apparatus is especially intended for the combustion of biomass, such as harvest refuse.

BACKGROUND ART

Many types of biomass, such as harvest refuse, contain large amounts of energy, said energy being difficult to utilize because the energy density is low and it therefore being uneconomical to transport the refuse over any considerable distance. There have therefore been proposed combustion devices, the flue gases of which, being generated by the combustion of biomass, can be controlled as to volume and temperature to be of use for instance in drying processes. In this connection reference may be made to DE No. 1 451 508, DE No. 2 356 507, SE No. 345 900, SE No. 365 604, NO No. 120 887, and U.S. Pat. No. 4,159,000.

A specific problem in connection with the combustion of biomass of different kinds, such as harvest refuse, forestry refuse, etc., is the disposal of the ash. This problem is accentuated when the combustion is carried out at temperatures where the ash wholly or partly is fused or very soft, in other words forms slag, and is deposited on the walls of the combustion chamber. Since the temperature of softening and of fusion varies with different kinds of fuel, the character of the ash is also subject to variation, if the furnace is used for different types of fuel. The ash handling equipment must therefore be such as to accomodate both solid and more or less liquid ash products.

Among other things, this means that the equipment must be able to scrape off such ash products as are burnt to the walls of the furnace and to deliver them to a discharge opening, from where the ash may be discharged from the furnace. This in turn implies that the combustion process must be controlled in such a way that the ash products at least substantially are deposited within a predetermined area of the furnace. Further, the scraping means and the associated equipment must be located and designed in such a way that they do not disturb the combustion process or the currents of air and flue gases, or, if such disturbance occurs, that the disturbance is such that the combustion and/or the ash deposition are not considerably impaired. In addition, the scraping means and the associated equipment in themselves must be able to resist the strain which is inflicted upon them in the combustion area, and in case ash and slag are deposited on the scraping means, this shall not either impair their function.

DISCLOSURE OF THE INVENTION

The object of the invention is to provide an improved apparatus for the combustion of biomass and other solid fuels which may be suspended in a flow of air. In particular, an object is to provide an improved system for separating slag and ashes. To accomplish these and other objects, the combustion chamber is essentially horizontal, according to a first characteristic of the invention, while fuel and air are added tangentially at the outlet end of the combustion chamber. This brings about the effect that the ash is accumulated in the inner part of the combustion chamber during the combustion process.

According to a second characteristic of the invention, the combustion chamber is provided at its inner end with means for scraping, intended to scrape loose ashes and slag from the walls and to transport the loosened material to an area at the cylindrical bottom of the combustion chamber, where there is provided an opening for the discharge of ashes and slag. Near this opening, there is arranged a hatch at a certain level below the inside of the cylindrical bottom of the combustion chamber, a space thus being created into which may be put a certain amount of ashes and slag which has been scraped off the walls of the combustion chamber and has been brought to this receiving space by said scraping means. It is suitable to let this hatch be the first hatch of an ash discharge sluice with a sluice volume which is greater than the volume of said ash receiving space, so that the sluice chamber is able to accomodate all the ashes and slag contained in the upper space when the upper sluice hatch opens. The sluice is part of a discharge conduit, which brings the ash from the discharge opening to an ash bin or the like. Preferably, the sluice is a mechanical sluice comprising said first and second hatches and controlling means for the opening and shutting of the two hatches in said order. In addition, or possibly as an alternative, a water trap may be provided in the discharge conduit.

Thus, the scraping means are designed both to scrape loose ash and slag from those parts of the walls of the combustion chamber where most of the combustion process takes place and to bring the ash products to the discharge opening and to "scrape them down" into said upper ash receiving space. The scraping means comprise at least one scraping unit with a scraper which is flush against the cylindrical wall and preferably extends helically along the inside of the cylindrical wall, intended to move loosened ash and slag toward the ash receiving space near the bottom wall. In addition, there is at least one scraping unit intended to scrape the end wall. The two scraping units, which may well be integrated, but which are preferably separate units, are preferably mounted on a drive shaft, which extends through the end wall and preferably also comprises a part which extends into the combustion chamber approximately the same distance as the axial length of that scraping unit which is intended to scrape the inside of the cylindrical wall of the combustion chamber. All scraping means are water-cooled so as to withstand the high temperature in the combustion chamber. This temperature may vary between 800° and 1200° C. depending on the moisture content and the air-to-fuel ratio. By virtue of the possibility according to the invention of handling both solid ash and more or less liquid, slag-like ash, that temperature may be chosen which corresponds to the optimal air/fuel ratio, which permits a relatively low excess of air and hence a high combustion temperature.

Another object of the invention is to provide a cyclone furnace which is able to perform at very high temperatures, which enhances efficience and a very small emission of unburnt products with the flue gases. To meet these two partly contradictory demands, the cyclone furnace according to yet another aspect of the invention is characterized in that at least its cylindrical mantle is covered with air conduits. The air of combustion is led through these conduits, thus being pre-heated before entering the combustion chamber. The heat required to accomplish this pre-heating is transmitted through the wall of the combustion chamber, and another effect is that there is no need to insulate the external wall. It is preferable to let the air of combustion enter the combustion chamber near the end wall and from there to flow helically along the mantle, so that it is gradually heated to a higher and higher temperature, before being led into the combustion chamber near the orifice of the cyclone furnace. A choke is provided at the entrance to the combustion chamber so as to raise the air velocity considerably. This makes it possible to keep the air velocity comparatively low as long as the air is circulating along the chamber wall, the pressure drop consequently being low and the necessary fan power small. It is preferable to let the end wall also be covered by air conduits, through which flows air which has been branched off from the first turn of that air conduit which runs on the outside of the mantle.

Further objects, aspects, and advantages of the invention will become apparent from the appended claims and the following description of a preferred embodiment.

BRIEF DESCRIPTION OF DRAWINGS

In the following description of a preferred embodiment, reference will be made to the accompanying drawings, wherein.

DESCRIPTION OF A PREFERRED EMBODIMENT

Figure 1:
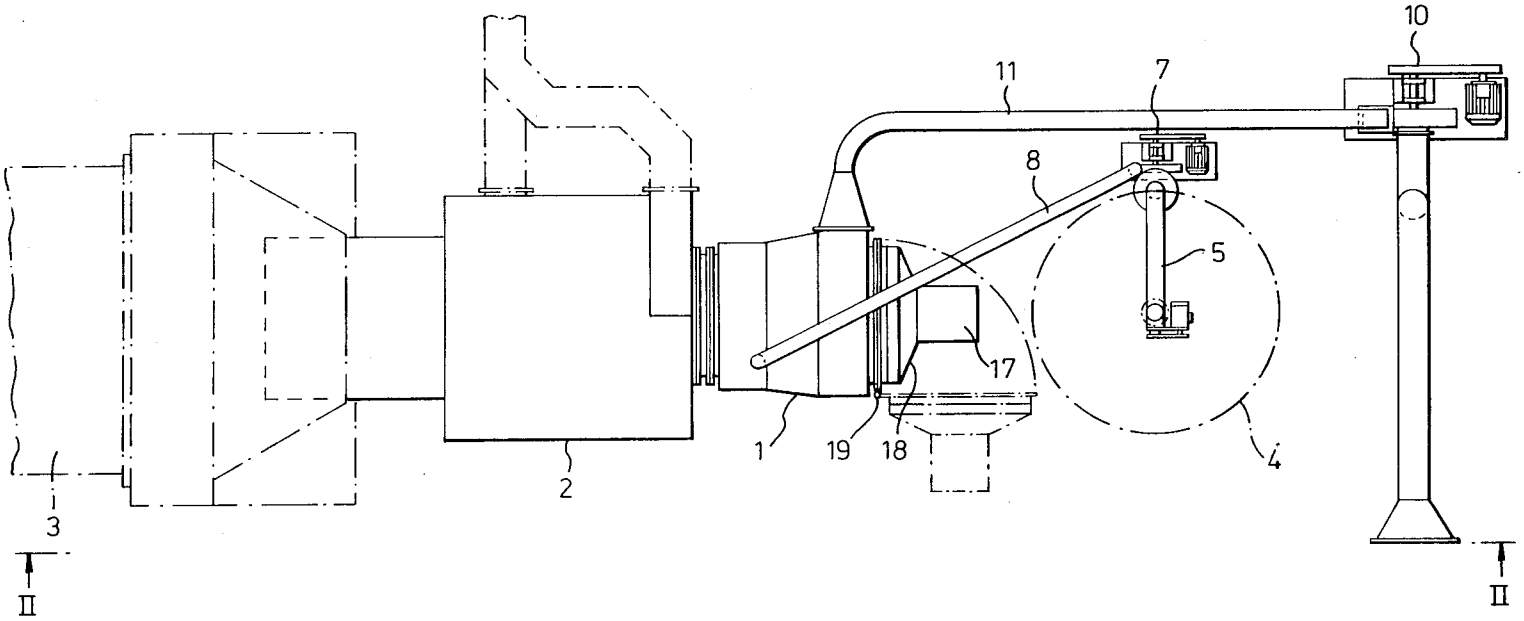
FIG. 1 is a plan view of an apparatus comprising a furnace in accordance with the invention, said furnace being used as a heat source for the drying of wood chips in a rotating chips dryer.
Figure 2:
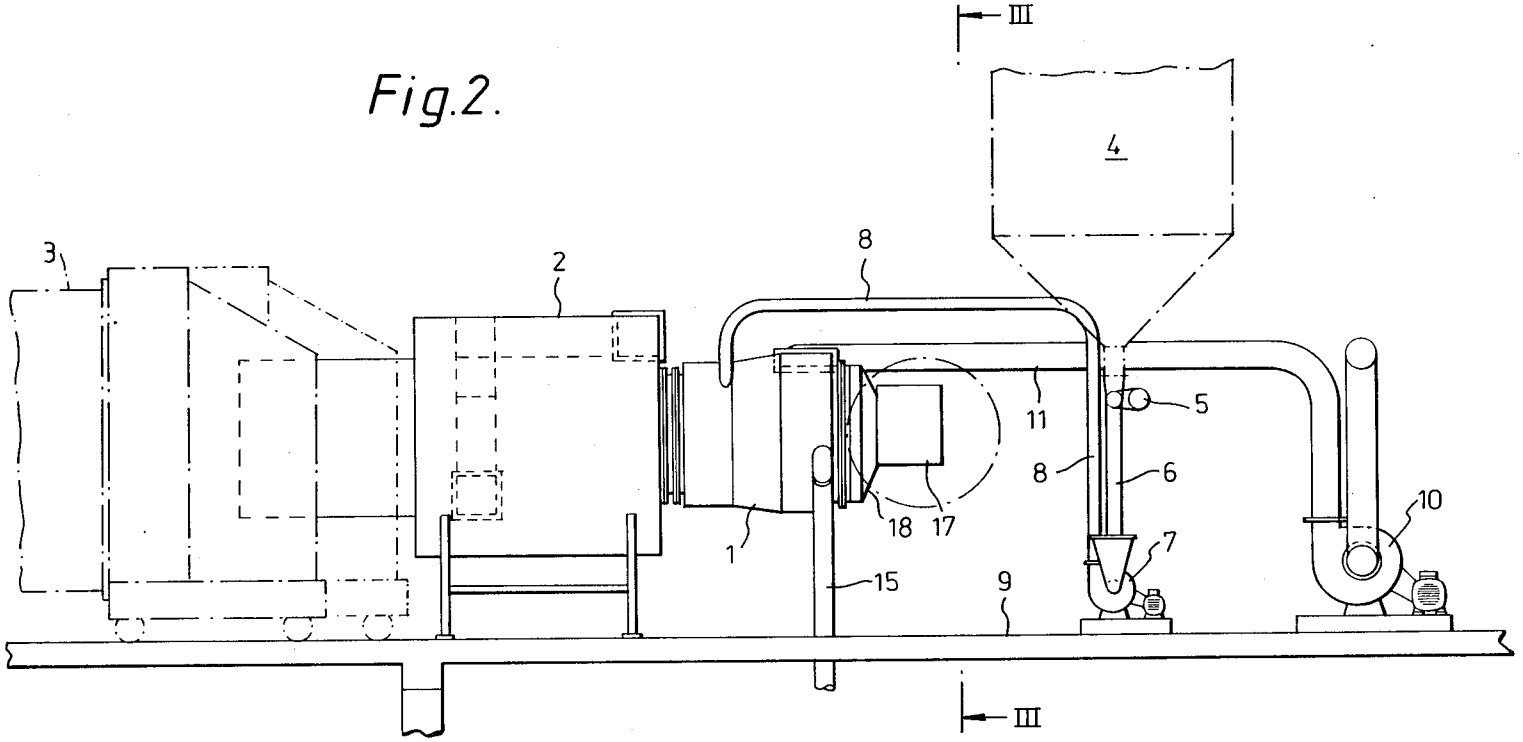
FIG. 2 is an elevation of the apparatus of FIG. 1, as viewed according to the indication II—II of FIG. 1.
Figure 3:
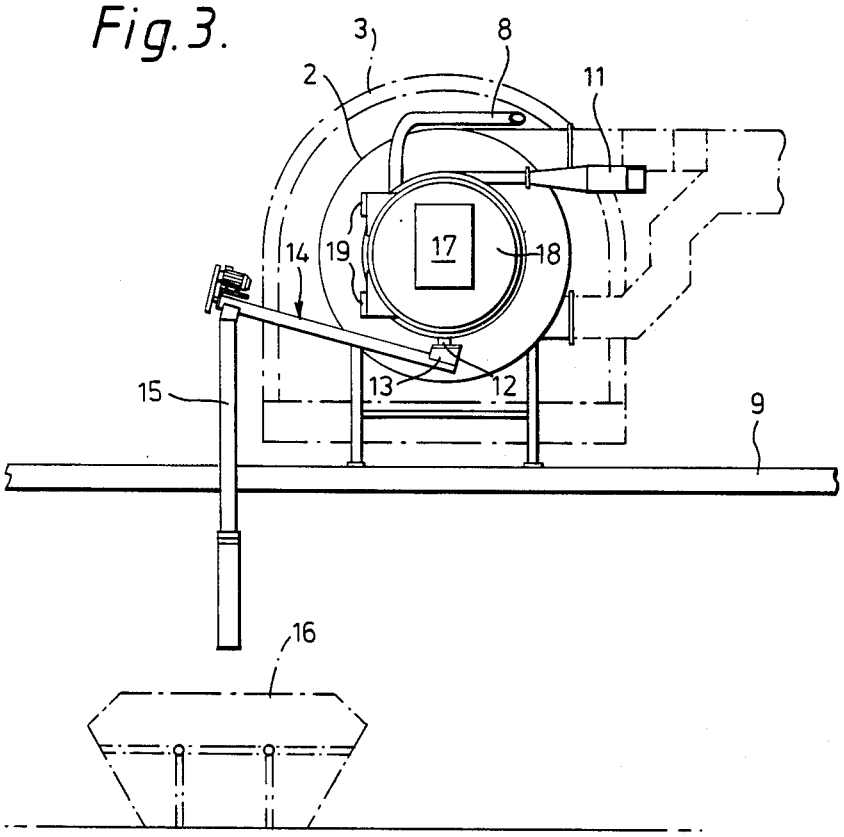
FIG. 3 is an end elevation of the same apparatus, as viewed according to the indication III—III of FIG. 2.

In FIGS. 1-3 a cyclone furnace according to the invention is generally designated by numeral 1. The furnace is part of a drying plant for wood chips and functions as a central heat generator. The flue gases from the furnace 1 have a temperature exceeding 1000° C. and are therefore mixed with cold air in a mixing chamber 2 to acquire a temperature of not more than 250° C. before being led into a rotating chips dryer 3. The furnace 1 is fed with solid fuel, such as pellets of straw, from a silo 4 by a feed worm 5 and a feed conduit 6 via a fan 7, which feeds the fuel together with a certain amount of air into the furnace, where it is injected tangentially near, but not adjacent, the outlet of the furnace. The entire apparatus is placed on a plate 9, which also supports a fan 10 for combustion air. This fan feeds combustion air to the cyclone furnace 1 through a conduit 11 for combustion air, which is connected tangentially to the rear part of the air-cooled mantle of the cyclone furnace 1. An ash and slag discharge conduit 12 is connected below the rear part of the furnace 1, see FIG. 3. A water trap 13 may be arranged below the conduit 12, with the additional purpose of extinguishing slag and ash possibly still aglow, before the slag and ash is transported to a container 16 via an ash discharge worm 14 and a chute 15. Within the furnace 1 there are scraping means, powered and cooled by a device 17 at the head 18 of the furnace. The head 18 may be loosened and swung aside on hinges 19.

For a more specific description of the cyclone furnace to follow, reference will be made at first to FIGS. 4, 5, and 6. A cylindrical combustion chamber 21 is defined by a cylindrical combustion chamber wall 22 of refractory material, an end wall 23, also made of refractory material, and a connective piece 24 with an outlet 25 for flue gases with a temperature exceeding 1000° C. and a velocity of 70–90 m/s. The connective piece 24 is also made of refractory material. Possibly, this piece could be provided with cooling circuits in the ceramic material near the outlet 25. The connective piece 24 is mounted to the furnace 1 by means of screws and may thus be loosened in case of replacement or repair. In addition, by choosing the proper dimensions for the connective piece 24, the furnace 1 may be adapted to different objects, so that a furnace of the same basic configuration may be used for different applications.

The refractory material of the furnace 1 is thickest at the end wall 23 and the inner part of the cylindrical wall 22 of the combustion chamber, where the highest temperatures are encountered. The cylindrical combustion chamber wall 22 narrows toward the connective piece 24, which in this embodiment is not water-cooled and therefore has a large wall thickness close to the outlet 25. On the outside of the combustion chamber wall 22 there is an inner sheet metal mantle 26 and on the outside of the end wall 23 there is a dished end wall plate 27. On the outside of the sheet metal mantle 26 and the end wall plate 27 there are air channels 28 and 29, respectively. The air channels 28 on the inner mantle 26 run three turns **28*a*, 28*b*, 28*c*, around the periphery of the mantle. In the first turns 28*a*, 28*b*, there is a transverse wall, forcing the air current in the channel to enter the next turn via a connection between the adjacent turns, such as between the turns 28*a* and 28*b* and between 28*b* and 28*c*, respectively. In this manner a single unbroken channel 28 is formed, extending approximately helically around the mantle 26 of the combustion chamber wall 22. The combustion air conduit 11, see FIGS. 1-3, is connected to an air inlet conduit 30, which is tangentially connected to the inner end of the air channel 28, specifically to the first turn 28*a* of this helix. Some of the combustion air flow is diverted from the air inlet conduit 30 through a conduit 31, which extends back to the head wall 18, where it opens into the inner turn 29*a* of a helical air channel 29. This air channel 29 continues tangentially at the end of its outer turn 33*a*, whence it continues with a return conduit 34 to the air channel 28** on the outside of the mantle.

Figure 10:
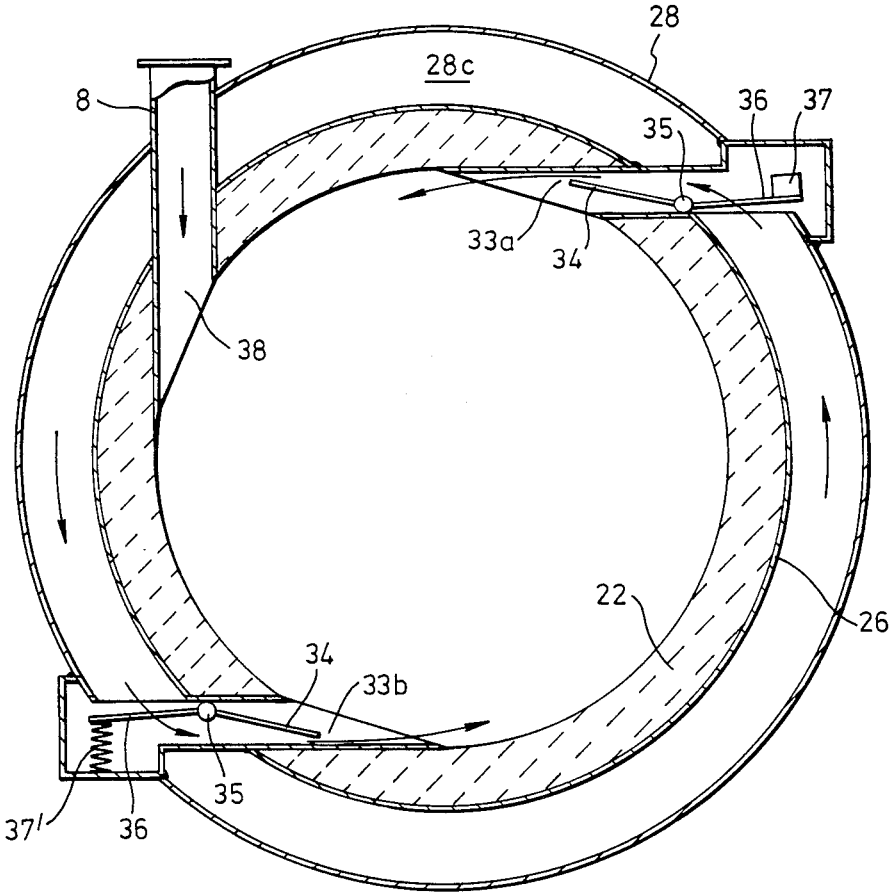
FIG. 10 is a false vertical section of the outlet end of the furnace, illustrating the arrangement of the fuel and air feed.

The "last turn" 28*c* of the channel 28 is not provided with any transverse wall. The air therefore is free to rotate within this final part before entering two air inlet openings 33*a* and 33*b* through the mantle 26 and the cylindrical combustion chamber wall 22 directly inside the connective piece 24. This is illustrated schematically in FIG. 10. Each of the air inlet openings 33*a* and 33*b* houses a throttle 34, which constitutes one of the arms of a lever, which turns about a fulcrum 35. The second lever arm 36 is provided at its end with a counterweight 37, or a spring 37', biasing the throttle 34 toward the closed position. This ensures that the combustion air flowing in through the openings 33*a* and 33*b* has a high velocity into the combustion chamber 21 even if the air flow is small, as is the case when the rate of fuel feed is low, as in turn is determined by the power output desired. With the illustrated embodiment the air velocity is raised from about 20 m/s in the channel 28 to between 80 and 90 m/s in the inlet openings 33*a* and 33*b*. It is possible to replace the counter-balanced throttles by inclined sliding doors, controlled by setting motors, to guarantee the desired air flow at all times. In this manner, the flow may be controlled with a greater accuracy and may be adapted to the varying demands so that the air velocity is always suitable and hence the cyclone effect in the combustion chamber 21 is always optimal.

Some distance inside the air inlets 33*a*, 33*b*, and at a distance from the outlet of approximately ¼ to ½ of total length of chamber 21, there is a fuel opening 38. This opening also opens tangentially into the combustion chamber, in the same direction as the flow of air. The axial distance between the air inlets 33*a*, 33*b* and the fuel feed opening 38 is so large that the combustion air current is undisturbed, which means that the air both swirls at a high speed along the combustion chamber wall and has a speed component directed axially toward the head 18 of the combustion chamber 21. The fuel being fed into the combustion chamber 21 through the opening 38, via the feed conduit 8, which extends through the air channel 28 and the mantle 26, is snatched by the passing air stream from the air inlets 33*a*, 33*b* and is fed further into the combustion chamber 21 along the cylindrical combustion chamber wall 22. In other words, the fuel being fed does not come into contact with the hot flue gases flowing centrally out of the combustion chamber 21 through the outlet 25.

Figure 4:
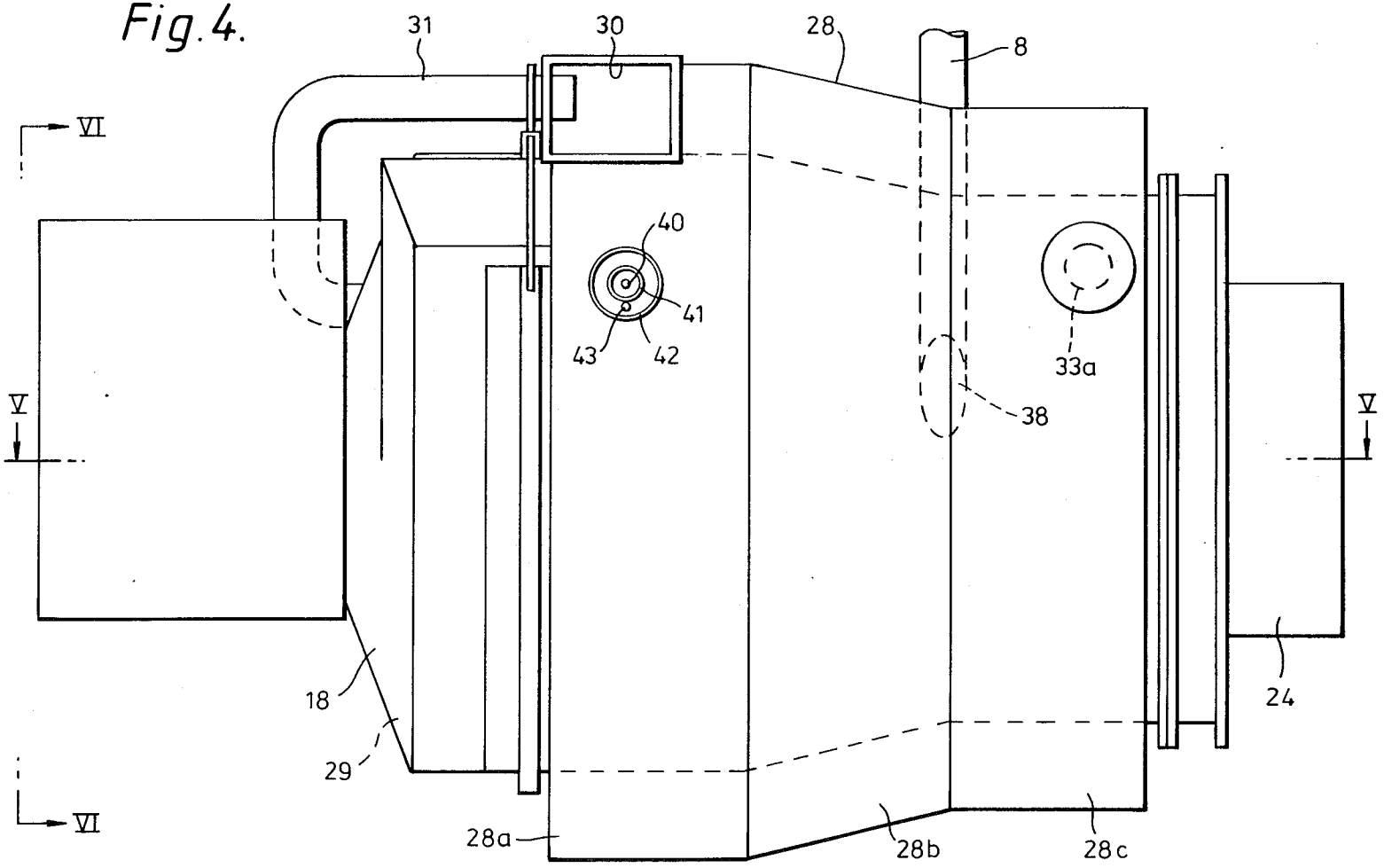
FIG. 4 is an elevation of a cyclone furnace according to the invention.

Still further inside the combustion chamber 21, close to the end wall 23, there is an oil burner, which in FIG. 4 has been symbolically designated 40. This oil burner may be of a conventional design and provided with an oil spray nozzle and an electric spark plug. These parts are arranged within a pipe 41, which extends through the air channel 28, the mantle 26, and the combustion chamber wall 22. The primary purpose of the oil burner is to start up the furnace 1. It is preferable that a second pipe 42 be arranged coaxially outside that pipe which contains the oil burner 40, and in the clearance between the two pipes 41 and 42 one or several oil feed 43 pipes may be arranged, so that more oil may be sprayed into the combustion chamber 21, there to burn, if for some reason there should be fed too little solid fuel into the furnace.

The oil burner 40 and said pipe and oil spray nozzles are arranged at the upper part of the combustion wall 22 so as not to be stopped-up by slag and ashes scraped loose from the walls.

Figure 7:
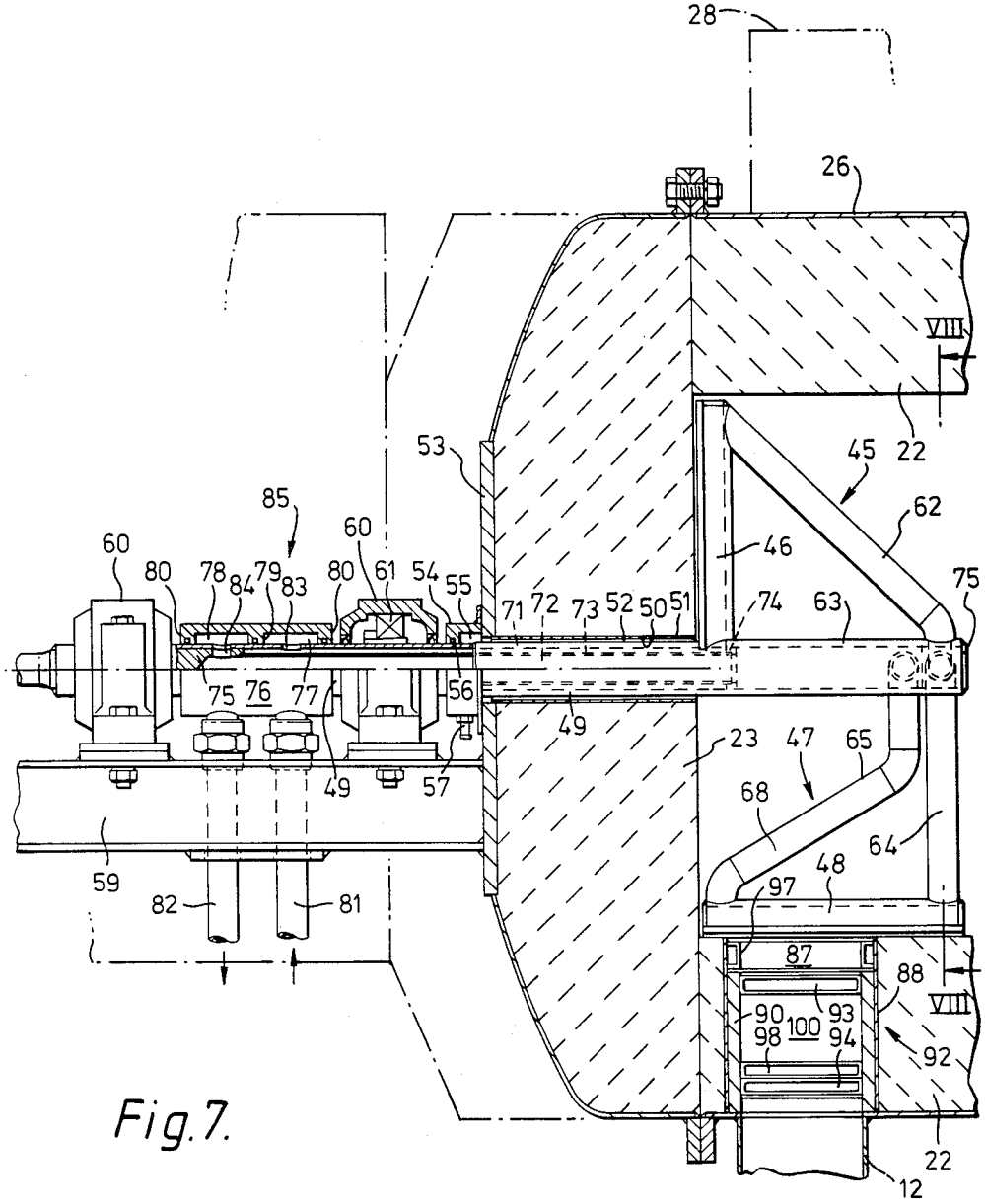
FIG. 7 is a vertical axial section through the head of the furnace and some adjoining parts of its cylindrical part showing the scraping means and certain elements connected to the outside of the head of the furnace.
Figure 8:
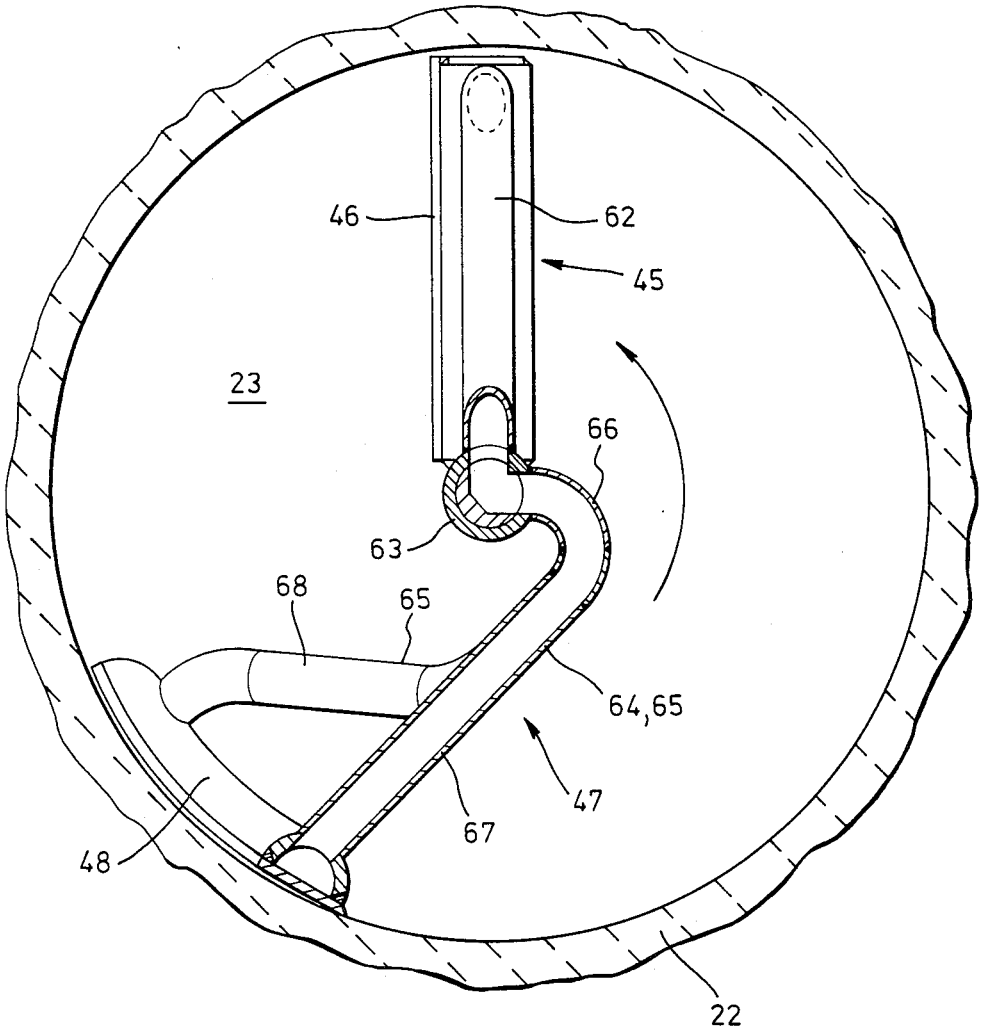
FIG. 8 is a view of the scraping means according to the indication VIII—VIII of FIG. 7.

The furnace 1 described above functions as follows. During the starting-up process air is blown in through the openings 33*a*, 33*b*. Oil is supplied to the burner 40 which is ignited electrically according to prior art. Then, granular solid fuel, preferably granular biomass, is entered through the fuel feed opening 38. When this fuel is aflame, the oil supply is closed and the flow of air and fuel is regulated as desired within the working limits of the furnace. The air of combustion, flowing at a high speed tangentially through the inlets 33*a*, 33*b* pulls that fuel along which is fed through the fuel feed opening 38, the mixture of air and fuel then following the inside of the cylindrical combustion chamber wall 22 along a track composed of both circular and axial motion, in other words helically, toward the furnace head 18. The fuel continues to rotate in the vicinity of the end wall 23, until it has been burnt up fully, while the flue gases move centrally along the central axis of the furnace 1 toward the outlet 25 and out therethrough. In the inner part of the combustion chamber 21, i.e. in the vicinity of the end wall 23 ash particles are separated from the flue gases, which run axially back through the outlet 25. The flue gases mainly consist of carbon monoxide and water vapour. The ash is deposited on the walls of the combustion chamber 21, mainly on the end wall 23 and the adjacent parts of the cylindrical combustion chamber wall 22. The ash may be solid or more or less liquid, i.e. slag-like, depending on the temperature and the chemical composition of the fuel. These conditions may vary. Whether the ash is solid or more or less liquid, it is necessary that it can be removed from the walls and be disposed of. This makes great demands on the ash discharge device, which must be able to loosen the ash efficiently from the walls and to transport it to an ash discharge opening. To be able to perform these duties, the equipment must be very robust. At the same time it must not interfere too much with the gas flow conditions in the innermost part of the combustion chamber 21, where the fuel is to whirl about, until it has been burnt up fully. In addition, the scrapers must withstand the high temperature inside the combustion chamber. The way to meet these almost incompatible demands will be disclosed in the following, with reference also to FIGS. 7 and 8.

According to the embodiment, two separate scraping units are provided, viz. a first scraping unit 45 comprising a first scraper 46 to scrape the end wall 23, and a second scraping unit with a second scraper 48 to scrape the cylindrical combustion chamber wall 22 in the vicinity of the end wall 23. The two scrapers 46 and 48 are mounted on a common shaft 49, extending through a bore 50 in the end wall 23. The bore 50 is lined with a thin sheet metal lining 51, the inner diameter of which is slightly larger than the outer diameter of the shaft 49, a small clearing 52 thus being created between the lining 51 and the shaft 49. On the outside of the end wall 23 there is a strong end plate 53, made of steel. The shaft 49 extends through this plate also and through a sealing muff 54, coaxially arranged on the outside of the plate 53. Inside the sealing muff 54 there is a chamber 55, sealed against the ambience by an O-ring 56. To the chamber 55 is connected a conduit 57 for cold air, through which cold air is entered into the chamber 55 under a pressure exceeding the pressure in the combustion chamber 21, and from there via the clearing 52 into the combustion chamber 21 to prevent flue gases from exiting the back way and damaging the transmission of the scraping units.

Figure 5:
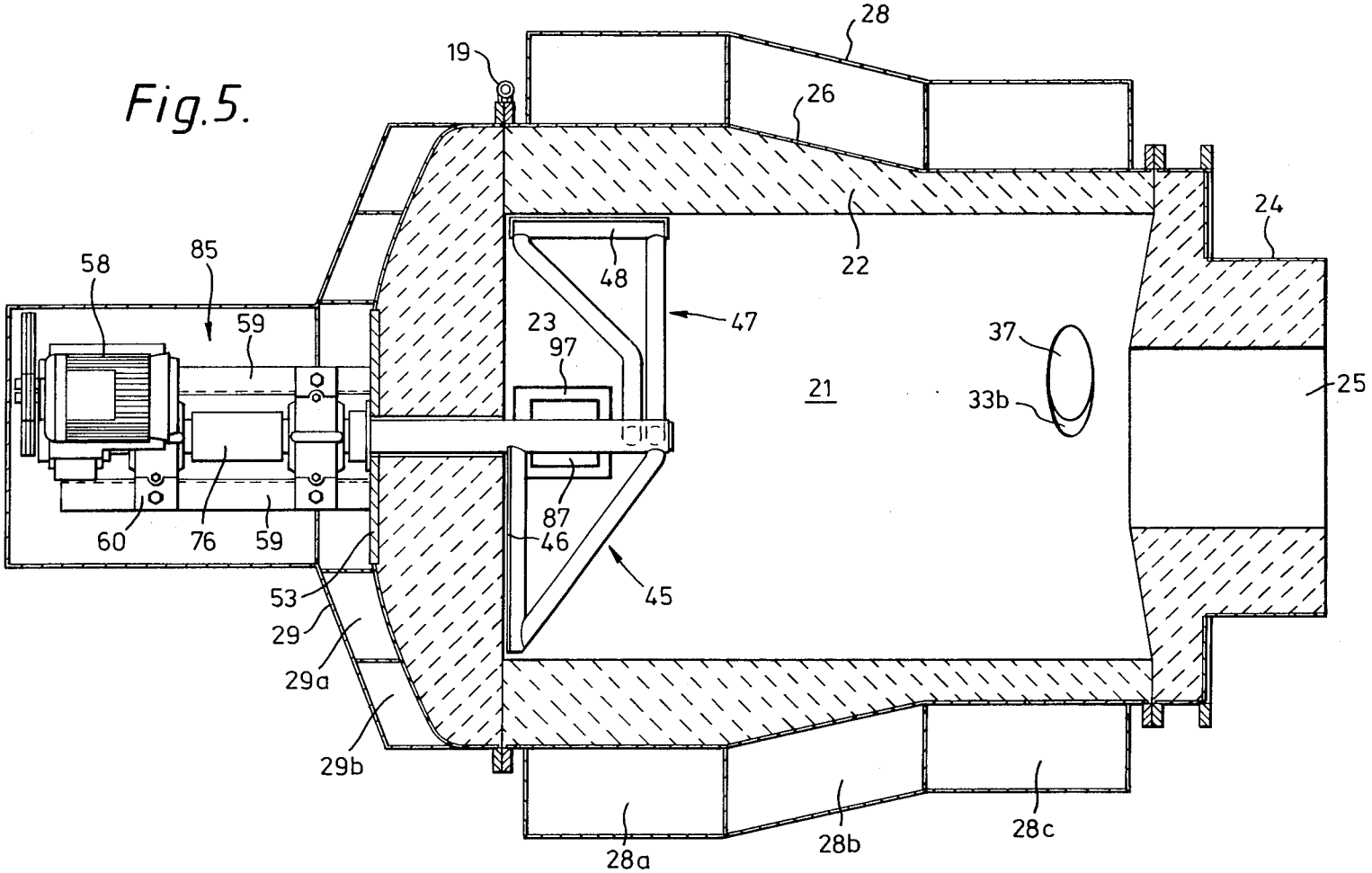
FIG. 5 is a horizontal axial section of the furnace of FIG. 4, taken along the line V—V.
Figure 6:
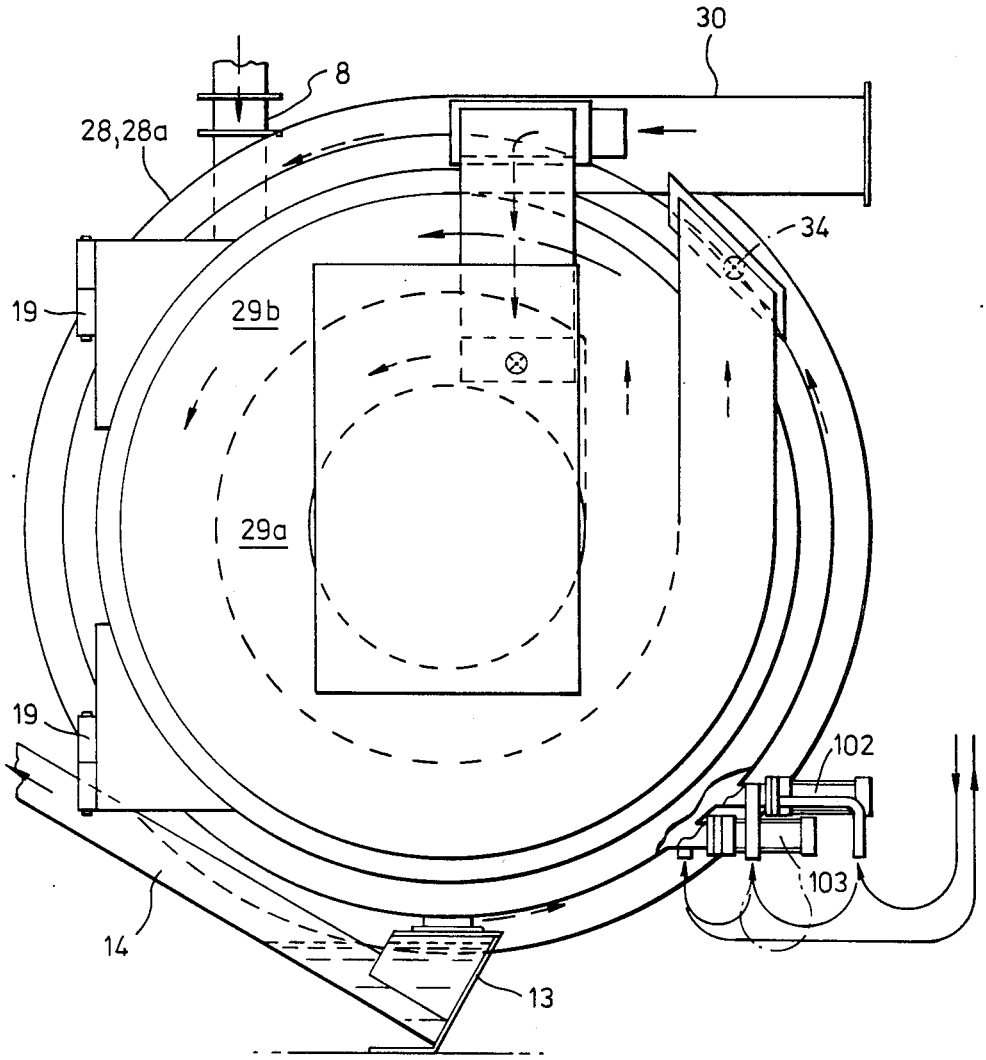
FIG. 6 is an end elevation according to VI—VI of the furnace of FIG. 4, including certain parts not illustrated in FIGS. 4 and 5.

A drive motor for turning the shaft 49 has been designated 58, see FIG. 5. This motor is placed on a pair of horizontal brackets 59 on the gable plate 53. These two brackets 59 also support a pair of bearing housings for the shaft bearings 61.

The head 18 is attached to the cylindrical part of the furnace 1 by means of screws. After loosening these screws, the head 18 may be swung aside on the hinges 19, a possibility made use of when the scraping units are to be de-slagged or some other maintenance be done. The first scraping unit 45 comprises the said first scraper 46 and a strut 62 extending at an angle of 45 from the outer end of the scraper 46 to the outer end of a part 63 of the drive shaft, extending into the combustion chamber 21. The scraper 46 extends radially from the shaft 49 and the strut 62 is arranged in the same radial plane. The design of the second scraper 48 is more complex. It is thus helical, so that it, when being turned by the shaft 49, moves loosened ash and slag toward the end wall 23. The two struts for the scraper 48, viz. an outer strut 64 and an inner strut 65, are of complex design. The two struts 64, 65 thus first extend with arched parts 66, see FIG. 8, outwards from the free end of the shaft 49, from where the outer strut 64 continues with a straight part 67 toward the outer end ot the scraper 48, while the inner strut 65 continues with a straight part toward the inner part of the scraper 48. The form of the struts 64, 65 is useful for several reasons. Firstly, the flow resistance is lowered, because the struts 64, 65 are bent along the direction of flow. Secondly the arched parts permit the scraper 48 to yield resiliently toward the centre, should it encounter some collection of ash or slag or some other obstruction which does not come loose directly. After passing the obstruction, the scraper may spring back into its original position. If the struts 64, 65 were directed purely radially instead, there would be a risk of the scraper 48 jamming, since the "apparent radius" would increase if the scraper were blocked.

Those active parts of the scrapers which are flush against the end wall 23 or the cylindrical wall 22 are reinforced with hard metal. The hard metal reinforcements have been designated 69 and 70, respectively.

The two scraping units 45 and 47 as well as the shaft 49 are made of pipes. An external pipe 71 extends through the entire transmission 72 outside the furnace all the way to the end of the shaft part 63 which extends into the combustion chamber 21. An inner pipe 72 ends flush with the rear edge of the first radial scraper 46, where the gap 73 between the two pipes is closed off by a ring seal 74. The other end of the two pipes is sealed by a common stopper 75.

On the outside of the tubular shaft 49, between the two bearing housings 60, there is arranged a cylindrical casing 76 for the supply of cooling water. This cooling water casing 76 is divided into two chambers, a first chamber 77 and a second chamber 78, a partition wall 79 separating the two chambers. There are two end walls 80. The through-bores for the shaft 49 through the walls 79 and 80 have been sealed by O-rings. To the first chamber 77 is connected a supply conduit 81 for cooling water and from the other chamber 78 runs a cooling water return conduit 82. The first chamber 77 is connected to the gap 73 between the pipes 71 and 72 by four openings 83 and there are four corresponding holes 84 between the second chamber 78 and the pipe 72. The cooling water supplied from a feeding line via the cooling water conduit 81 pass the following channels and rooms in the order stated: the chamber 77, the connective opening 83, the gap 73 between the outer pipe 71 and the inner pipe 72 of the shaft 49, the first scraper 46, the strut 62, the scraper 48, the strut 65, the shaft part 63 extending into the combustion chamber 21, the inner pipe 72, the connective openings 84, the chamber 78, and finally the return conduit 82 from where it is discharged to an open drain.

The ash and slag which is scraped loose from the end wall 23 and the cylindrical combustion chamber wall 22 by means of the scrapers 46 and 48 is continually fed by the scraper 48 to an ash discharge opening 87 in the bottom of the cylindrical combustion chamber wall 22 near the end wall 23. The distance from the end wall 23 is approximately equal to the axial width of the scraper 46. The ash discharge opening 87 has a surrounding metal pipe 88, which runs radially through the refractory combustion chamber wall 22. On the outside the pipe 88 is welded to the sheet metal mantle 26. The inside of the pipe 88, except the upper rim member 97, is lined with refractory material 89, forming a tubular channel 90, which continues in the form of said ash discharge conduit 12, which extends through the air channel 28 on the outside of the mantle 26. As was described with reference to FIG. 3, the conduit 12 is onnected to a chute 15 over the container 16 via a possible water trap and an ash discharge worm. The tubular channel 90 is connected to the air channel 28 via a smaller opening 91. Through this opening 91, air flows into the tubular channel 90. In the tubular channel 90 there is an ash discharge sluice, generally designated 92. This sluice comprises an upper hatch 93 and a lower hatch 94. The upper hatch 93 is water-cooled and may be slid in or out of the channel 90 by means of a pneumatic cylinder 102, not shown, see FIG. 6. A drawbar coupled to this pneumatic cylinder has been designated 95. Correspondingly, the lower hatch 94 may be controlled by a second pneumatic cylinder 103 independently of the first pneumatic cylinder. A drawbar coupled to the lower hatch 94 has been designated 96. A lower ash wiper is designated 98. The wall 97' of the rim member 97 works as an upper ash wiper.

Figure 9:
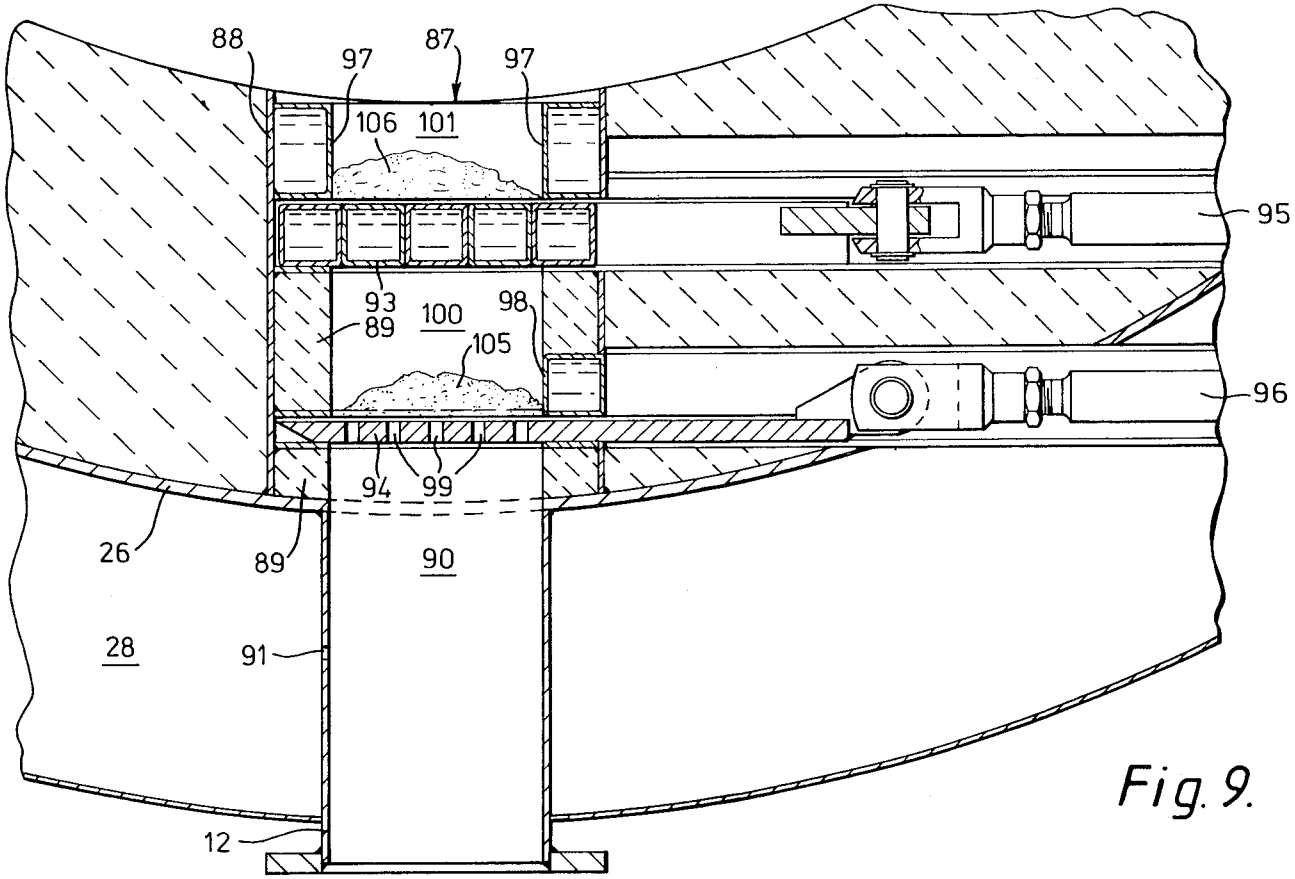
FIG. 9 is a sectional view perpendicular to the axial direction showing an ash discharge sluice and the controlling means for the sluice hatches.

The cooling water for the water-cooled parts of the ash discharge sluice 92 is led from a main supply line first into the upper hatch 93, inside which the water follows a meander path. Thence, the water flows through the upper rim member 97 and then through the lower ash wiper 98, before being led to a drain. Air, entering the channel 90 through the opening 91, flows upwards through holes 99 in the lower hatch 94, in order to burn up any possible unburnt fuel products 105, accumulating on this hatch, and the flue gases from this combustion find their way up around the upper ash hatch 93 via slits. As indicated in FIG. 9, the sluice chamber 100 is slightly larger than the space 101 in the channel 90 over the upper hatch 93. This prevents the sluice chamber from becoming over-filled with ash, slag, and unburnt products 106, when the upper hatch opens and the contents of the space 101 above the hatch 93 fall down into the sluice chamber 100, which has previously been emptied of its contents.

According to the preferred embodiment, the upper ash wiper 97 is designed as a rim surrounding the discharge opening 87 and lining the space 101 over the upper hatch 93. This rim member 97 extends from just above the hatch 93 up to be flush with the inside of the cylindrical wall 22. As cooling water flows through the rim member 97, it will from all sides cool any material that is scraped down into the space 101. Hence any more or less viscous slag, which enters the space 101, will freeze and be brittle. This is important because it otherwise can block the discharge opening 87. Due to the cooling performed by the water cooled ash wiping rim 97 this is, however, efficiently prevented.

We claim:

1. A cyclone furnace for the combustion of solid fuels with air to form ash or slag or gases or mixtures thereof comprising a generally cylindrical combustion chamber, having a horizontal axis, including a generally cylindrical enclosing wall having an inner surface, a first end and a second end, said first end spaced apart from said second end along said horizontal axis, said first end being closed by an end wall having an end wall inner surface, said second end being open so as to define an outlet for combustion gases; at least one inlet opening, tangentially formed in said generally cylindrical enclosing wall proximate said second end, for feeding fuel and air to said combustion chamber; an outlet opening, formed in said generally cylindrical enclosing wall at the bottom of said combustion chamber proximate said end wall, for discharging ash and slag from said combustion chamber; an ash discharge conduit connected to said outlet opening and extending away from said combustion chamber; scraping means, disposed within said combustion chamber, for scraping loose ash and slag from said end wall inner surface and from at least a portion of the inner surface of said generally cylindrical enclosing wall adjacent said end wall; an ash discharge sluice comprising a first ash hatch provided in said ash discharge conduit, a second ash hatch provided in said ash discharge conduit, and a control means for opening and closing said first and second ash hatches, said first hatch being located in said discharge conduit a first predetermined distance away from said combustion chamber so as to form an ash collecting space of a first predetermined volume between said inner surface of said cylindrical enclosing wall and said first hatch wherein ash and slag may be collected by said scraping means; said second hatch being located in said discharge conduit a second predetermined distance away from said combustion chamber, said second predetermined distance being greater than said first predetermined distance so as to form a sluice chamber of a second predetermined volume, said second predetermined volume being greater than said first predetermined volume.

2. The cyclone furnace as in claim 1, wherein said scraping means is arranged to be rotated about said horizontal axis of said combustion chamber.

3. The cyclone furnace as in claim 1, further comprising rotator means for rotating said scraping means about said horizontal axis; said rotator means comprising a rotatable drive shaft having a free end extending along said horizontal axis through said end wall, a portion of said drive shaft extending axially into said combustion chamber, and a driving means, disposed outside said combustion chamber and operably connected to said drive shaft, for rotating said drive shaft about said horizontal axis; said scraping means comprising a first scraping unit and a second scraping unit, said first scraping unit substantially extending from said drive shaft across said end wall inner surface to said inner surface of said generally cylindrical enclosing wall to scrape said end wall, said second scraping unit having an axial length and extending from said portion of said drive shaft extending axially into said combustion chamber to the inner surface of said generally cylindrical enclosing wall to scrape at least a portion of the inner surface of said generally cylindrical enclosing wall proximate said end wall and to move the scraped-off material to said outlet opening.

4. The cyclone furnace as in claim 3, wherein said first scraping unit comprises a first scraper extending radially from said drive shaft across said inner surface of said end wall and a strut extending from an outer portion of said first scraper to the free end of said drive shaft.

5. The cyclone furnace as in claim 3, wherein said second scraping unit comprises a second scraper supported by two support arms extending from said portion of said drive shaft extending axially into said combustion chamber.

6. The cyclone furnace as in any one of claims 3, 4 or 5 wherein said portion of said drive shaft extending axially into said combustion chamber has an axial length essentially equal to the axial length of said second scraping unit.

7. The cyclone furnace as in claim 5, wherein said second scraper extends helically along the inner surface of said generally cylindrical enclosing wall to move loosened ash and slag toward said end wall upon rotation of said scraper means about said horizontal axis.

8. The cyclone furnace as in any one of claims 1, 2, 3, 4, 5 or 7 wherein said scraping means is water-cooled.

9. The cyclone furnace as in any one of claims 4 or 5 wherein a cooling water conduit runs through said first scraper, said second scraper, said strut, said two arms and said portion of said drive shaft extending axially into said combustion chamber.

10. The cyclone furnace as in claim 9 further comprising a rim formed in said outlet opening, said rim surrounding said ash collecting space, said rim being water-cooled.

11. The cyclone furnace as in claim 1, further comprising at least one air supply conduit opening into said sluice chamber so as to allow combustion of any possible unburnt residues in the ash during the time the ash stays in said sluice chamber before being discharged from said sluice chamber.

* * * * *